US012663008B2

(12) United States Patent
Hoefel et al.

(10) Patent No.: US 12,663,008 B2
(45) Date of Patent: Jun. 23, 2026

(54) SYSTEMS AND METHODS OF PREDICTION AND MANAGEMENT OF SCALING ON COMPONENTS

(71) Applicant: Sensia Netherlands B.V., Rotterdam (NL)

(72) Inventors: Albert Hoefel, Sugar Land, TX (US); Jonathan Chong, Calgary (CA); Garud Sridhar, London (GB)

(73) Assignee: Sensia Netherlands B.V., Rotterdam (NL)

( * ) Notice: Subject to any disclaimer, the term of this patent is extended or adjusted under 35 U.S.C. 154(b) by 73 days.

(21) Appl. No.: 18/438,161

(22) Filed: Feb. 9, 2024

(65) Prior Publication Data

US 2024/0271625 A1 Aug. 15, 2024

Related U.S. Application Data

(60) Provisional application No. 63/444,776, filed on Feb. 10, 2023.

(51) Int. Cl.
*F04D 15/00* (2006.01)
*E21B 43/12* (2006.01)
(Continued)

(52) U.S. Cl.
CPC ..... *F04D 15/00* (2013.01); *E21B 43/128* (2013.01); *F04D 13/08* (2013.01); *F04D 29/588* (2013.01); *F04D 29/708* (2013.01); *F04D 1/06* (2013.01)

(58) Field of Classification Search
CPC ..... F04D 15/00; F04D 13/08; F04D 29/588; F04D 29/708; F04D 1/06; F04D 15/0088;
(Continued)

(56) References Cited

U.S. PATENT DOCUMENTS 11,208,876 B2 12/2021 Eslinger et al.
2013/0175030 A1* 7/2013 Ige ..... G05B 15/02 700/282
(Continued)

FOREIGN PATENT DOCUMENTS

JP 3710553 B2 * 10/2005
WO WO-2022/081533 A1 4/2022

OTHER PUBLICATIONS

International Search Report and Written Opinion for Appl. Ser. No. PCT/US2024/015232 dated May 31, 2024 (12 pages).
(Continued)

*Primary Examiner* — Dominick L Plakkoottam
(74) *Attorney, Agent, or Firm* — FOLEY & LARDNER LLP

(57) ABSTRACT

Systems and methods provided herein relate to a well site or other plant. Systems and methods are employed to determine fouling and/or reduce maintenance and down time associated with equipment that is subject to fouling conditions due to their operating environments in some embodiments. Fouling can include but is not limited to scale formation due to mechanical, thermal, chemical or combinations of such phenomenon. These phenomenon are initiated and progressively exacerbated as the equipment interacts with gaseous, solids and/or liquids from the operating environment. The equipment includes stationary and rotary equipment including but not limited to pump systems, valves, piping, heat exchangers, and plumbing utilized to move fluid in a well in a subterranean environment.

20 Claims, 3 Drawing Sheets

(51) Int. Cl.

| | |
|---|---|
| ***F04D 1/06*** | (2006.01) |
| ***F04D 13/08*** | (2006.01) |
| ***F04D 29/58*** | (2006.01) |
| ***F04D 29/70*** | (2006.01) |

(58) Field of Classification Search
CPC ..... F04D 13/10; E21B 43/128; E21B 37/06; E21B 2200/20; F05D 2260/81; F05D 2260/82; F05D 2260/821
See application file for complete search history.

(56) References Cited

U.S. PATENT DOCUMENTS

| | | | | |
|---|---|---|---|---|
| 2020/0208639 | A1* | 7/2020 | Eslinger | E21B 43/128 |
| 2022/0010793 | A1* | 1/2022 | Hoefel | F04D 15/0066 |
| 2023/0399938 | A1* | 12/2023 | Hernandez de la Bastida | E21B 37/06 |

OTHER PUBLICATIONS

International Preliminary Report on Patentability on International Appl. No. PCT/US2024/015232 dated Aug. 12, 2025.

* cited by examiner $$P_loss = -2\lambda\pi(Tm - T_skin)\ln(ro/ri)\,dl$$

SYSTEMS AND METHODS OF PREDICTION AND MANAGEMENT OF SCALING ON COMPONENTS

CROSS REFERENCE TO RELATED APPLICATIONS

This application claims the benefit of and the priority to U.S. Provisional Patent Application No. 63/444,776, filed Feb. 10, 2023, the entire disclosure of which is incorporated by reference herein.

BACKGROUND

Various types of equipment can be utilized in various processes can be subject to fouling. For example, components used in petroleum and gas production, processing, and refinement can be subject to fouling or scaling due to deposits of material forming on surfaces. Such components include but are not limited to pump systems, valves, piping, heat exchangers, and plumbing utilized to move fluid in a well in a subterranean environment.

SUMMARY

One implementation of the present disclosure relates to a method of estimating system variables including but not limited to estimates or indirect calculations of motor revolutions per minute (RPM) (e.g., for asynchronous motors), peak winding temperature, flow rate prediction, motor power loss, pump power loss, motor housing temperature, and other variables that are difficult to directly measure. Such values can be difficult to obtain especially when an associated component is disposed below a surface of the Earth.

One implementation of the present disclosure relates to a method of estimating average scaling thickness based on tracking the difference between expected behavior and observed behavior. One implementation of the present disclosure relates to a method of estimating average scaling thickness based upon winding temperature being above a threshold. The threshold can vary with estimated power loss and estimated cooling. One implementation of the present disclosure relates to a method of estimating pump health based on discrepancy of estimated versus measured pressure difference and a difference between estimated fluid temperature increase and measured temperature increase.

One implementation of the present disclosure relates to a method of optimization, utilizing one or more actuators (e.g., control knobs or other interface): to maximize the efficiency of injected scaling inhibitor, to maximize the efficiency of injected cleaning fluid for cleaning cycles, to maximize the efficiency of injected cooling fluid as an additional means of lowering operating temperatures, to select choke and/or rpm to avoid temperature increase at the motor housing above the critical solids fall out (precipitation) temperature, to perform any one or combination of the above when scale has started forming, and/or to manage the rate of scale buildup over time to prolong useful life.

One implementation of the present disclosure relates to a method of a predicting "what-if" scenarios when scale has started forming (e.g., the response of critical system variables to potential actuator changes). The scenarios can involve one or more of: motor rpm (for asynchronous motors), peak winding temperature, flow rate prediction, motor power loss, pump power loss, motor housing temperature, and fluid intake and discharge pressure and temperature.

One implementation of the present disclosure relates to the integration of the model within closed-loop optimization schemes: as a monitoring means or advisor or combined with feedback and predictive based controllers in an automation framework.

One implementation of the present disclosure relates to systems and/or models for implementing the above methods.

Another embodiment of the present disclosure relates to a method of controlling a pump system. The pump system includes a pump disposed within a well and an electric motor that drives the pump. The method includes using a model to identify temperatures and/or scaling associated with the pump. The method further includes operating the pump system based on outputs of the model.

Yet another embodiment of the present disclosure relates to a controller for controlling a pump system. The pump system includes a pump disposed within a well and an electric motor that drives the pump. The controller includes one or more processors and a memory. The one or more processors are configured to identify temperatures and/or scaling associated with the pump using a model. The one or more processors are further configured to operating the pump system based on outputs of the model. What is claimed is:

Some embodiments relate to a pump system for a pump disposed within a well. The pump system includes a controller including an optimizer configured to receive constraints and provide activations to the pump to maximize production and lifetime or minimize cost, stress or maintenance. The pump system also includes an estimator configured to estimate an estimated factor in response to measured parameters from the pump, the estimated factor comprising a torque, shaft speed, water cut, motor/pump output power, flow, a gas volume fraction, skin temperature, pump efficiency, or well efficiency, wherein the the optimizer is configured to receive the estimated factor, and wherein the controller is configured to operate the pump using the activations.

In some embodiments, the pump includes an electric motor. The constraints includes one or more of: a maximum temperature of a motor winding of the motor, a maximum temperature of a motor housing of the motor, and up and down thrust wear parameter, or equipment ratings. In some embodiments, the constraints includes a maximum temperature of a motor winding of the motor, a maximum temperature of a motor housing of the motor, and up and down thrust wear parameter, and equipment ratings. In some embodiments, the activations comprising a cooling mass flow, a drive frequency, and a choke position. In some embodiments, the measured parameters comprise a pressure, a motor voltage, or a motor current.

Some embodiments relate to a pump system for a pump disposed within a well. The pump includes an electric motor. The pump system includes a digital twin configured to estimate motor housing skin temperature of the motor and to detect scaling thickness in the pump system The digital twin includes a thermal mode and a motor model for providing data so that the scaling thickness and the housing skin temperature can be provided.

In some embodiments, the thermal model receives well head temperature data, winding temperature data, intake temperature data, and an intake pressure data from sensors. In some embodiments, the thermal model receives motor loss data from the motor model, and water cut and flow speed data from a flow model. In some embodiments, the motor model is a model representing motor characteristics of the motor configured to receive voltage data, current data, drive frequency data, and power factor data for the motor and configured to provide motor loss data. In some embodiments, the thermal model receives data from a flow model and the flow model is a velocity flow reduced order model configured to receive well head data, torque data, shaft speed data, discharge pressure data, well head pressure data, and intake pressure data from sensors.

In some embodiments, the sensors include computing units configured to response to sensor data and provide water cut, and flow speed data. In some embodiments, the motor model is a reduced order model. In some embodiments, the thermal model is a reduced order model. In some embodiments, the digital twin is configured using offline techniques using one or more simulators. In some embodiments, the one or more simulators are configured to simulate or estimate choke percentage or water output for different values of speed of the pump.

Some embodiments relate to a method of controlling a pump system. The pump system includes a pump with a motor, the method includes optimizing operation of the pump system to maximize efficiency of injected scaling inhibitor, to maximize efficiency of injected cleaning fluid for cleaning cycles, to maximize efficiency of injected cooling fluid to lowering operating temperatures, or to select choke or motor speed to avoid temperature increase at a motor housing above critical solids fall out temperature. The method also includes providing activations to achieve the operation.

In some embodiments, the optimizing is performed, to manage rate of scale buildup over time to prolong useful life. In some embodiments, the method further includes estimating peak winding temperature, flow rate prediction, motor power loss, or fluid intake and discharge pressure and temperature. In some embodiments, optimizing is performed within a closed-loop optimization schemes. In some embodiments, the method further includes estimating motor housing temperature for the motor.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Figure 1:
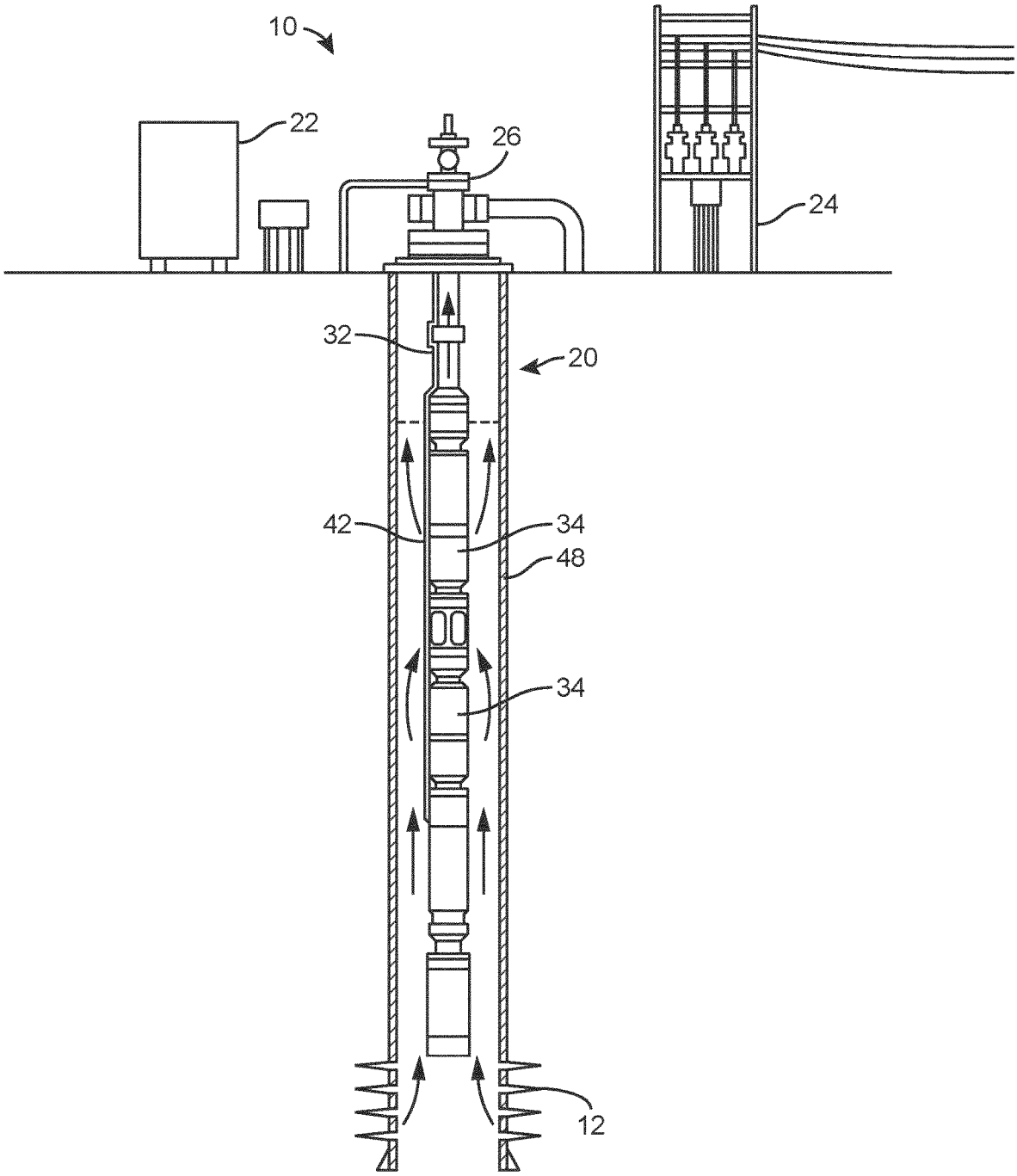
FIG. 1 is a schematic drawing of a well site, according to some embodiments.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Systems and methods are employed to detect possible fouling (e.g., scaling) and/or to reduce maintenance and down time associated with equipment that is subject to fouling conditions due to their operating environments in some embodiments. Fouling can include but is not limited to scale formation due to mechanical, thermal, chemical or combinations of such phenomenon. These phenomenon are initiated and progressively exacerbated as the equipment interacts with gaseous, solids and/or liquids from the operating environment. The equipment includes stationary and rotary equipment including but not limited to pump systems, valves, piping, heat exchangers, and plumbing utilized to move fluid in a well in a subterranean environment.

In some embodiments, components of petroleum and gas pumping, processing and refining systems can be subject to fouling. For example, at a well site, downhole electrical submersible pumps (ESPs) operate in the well bore with a downhole electrical motor. The electrical motor housing and the ESP pump are exposed to produced fluids from the downhole reservoir. In some cases, the produced fluid (e.g., produced brine with high calcium content) can create deposits inside the pump and on the motor housing. Temperature increases of the produced fluid increases the creation of deposits (e.g., deposition rate is often related to a decrease of solubility associated with rising temperatures). In some cases, the produced fluids may contain completion treatments (such as polymers) that are more sensitive to thermal reactions that can cause precipitation of the polymers that stick to surfaces.

In some embodiments, systems and methods are used with pump systems, including, but not limited to, ESPs (e.g., instrumented high temperature ESPs), reciprocating pump systems (e.g., sucker rod pump systems), and other devices that extract fluids from a well. In some embodiments, the systems and methods sense or detect conditions associated with fouling and mitigate the fouling or fouling rates by reducing heat dissipation or injecting chemicals to either inhibit the scale, clean the surfaces or cool down the contact zones. In some embodiments, fluid chemistry is used to mitigate the decrease in solubility by controlled chemical injection. In some embodiments, a reduction of heat dissipation of the motor mitigates the decrease in solubility and is achieved by operating the motor at lower power levels.

In some embodiments, systems and methods determine produced fluid chemistry, flow speed and motor housing temperature indirectly (e.g., not directly measured) to avoid cost and reliability issues associated with direct measurements. In some embodiments, downhole motor winding end turn temperature, inflow and discharge temperatures and intake and discharge pressures are used to determine one or more of produced fluid chemistry, flow speed and the motor housing temperature. In some embodiments, other measurements and one or more actuator settings can be used with prediction models to determine flow speed, scaling, scaling rate and/or skin temperature. In some embodiments, the prediction models can be used in an optimization context to optimize any actuator setting, such as inhibitor injection, pump speed and/or production choke. In some embodiments, the systems and methods sense and address scaling in areas of lower velocity (lower turbulence), such as the motor housing versus pump stages.

In some embodiments, the model can use any type of downhole measurements, (e.g., from a production life cycle management service (e.g., lift IQ service from Schlumberger). In some embodiments, the model can use installation parameters and additional measurements (data acquisition at high sampling rates of current and voltage from cables) to improve the reliability of predictions models. In some embodiments, the systems and methods are used for integrated well site automation products in the field, integrated cloud products (for instance reservoir monitoring, modeling, validation, planning, optimization), and statistical data analytics for process and design improvements.

With reference to FIG. 1, a well site 10 includes a subsurface pump 20, a controller 22, electrical transformers 24, and a well head 26. Produced fluids 12 are pumped by pump 20 to well head 26. Subsurface pump 20 can includes one or more ESPs each including an electric motor controlled by a variable speed drive in controller 22. The variable speed drive adjusts output of pump 20 by controlling the speed of the electric motor via signals to the armature, rotor/stator, or other winding of the motor. The motors are two pole, three phase induction motors in some embodiments. Controller 22 can also include a user interface or a computer to provide various settings for well site operations.

Electrical transformers 24 provide power (e.g., electric voltage and current for the variable speed drive. Controller 22 includes circuits and components that can protect components of well site 10 by shutting off power if normal operating limits are not maintained. Power cables 32 supply the electric signals to one or more motors through armor protected, insulated conductors. Power cables 32 are round except for a flat section along the one or more ESPS and motor protectors where space is limited in some embodiments. In some embodiments, the motor protectors connect pump 20 to motor and isolate the motor from produced fluids and other well fluids. The motor protectors serve as an oil reservoir and equalize pressure between the well bore and the well casing or tubing casing annulus 48 and allow expansion and/or contraction of motor oil in some embodiments.

Pump housing 34 for pump 20 includes multi-stage rotating impellers and stationary diffusers in some embodiments. The number of stages (e.g., centrifugal stages) is related to the rate, pressure and required power and can be any number from 1 to n depending on design criteria and well site parameters. Gas separators 42 can be employed to segregate some free gas from produced fluids into the tubing casing annulus 48 by fluid reversal or rotary centrifuge before gas enters pump 20. Intakes to pump 20 allow fluids to enter the pump 20 and may be part of a gas separator 42. In some embodiments, the well site 10 is for a cased well or an open well. For example, a partially cased well may include an open well portion or portions. An annular space may exist between an outer surface of tubing casing annulus 48 and the pump 20.

Figure 2:
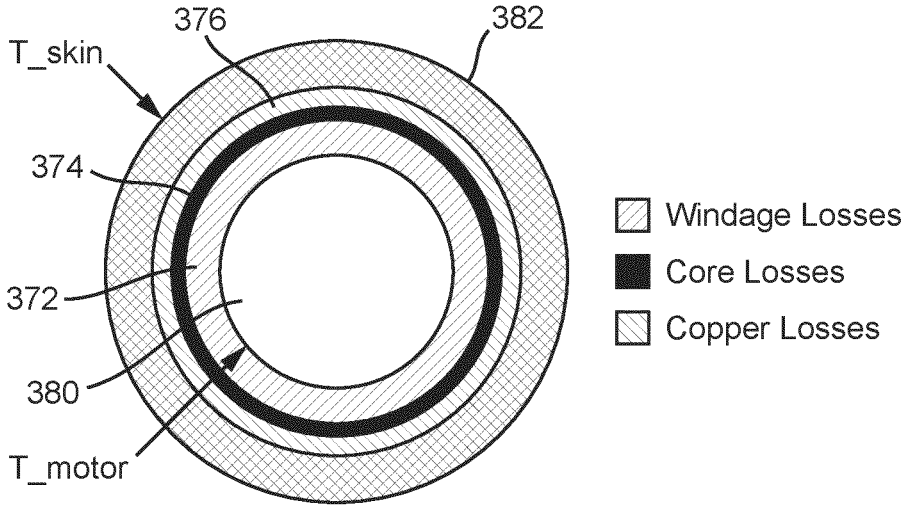
FIG. 2 is a schematic block diagram of system including a controller, components and sensors, according to some embodiments.

FIG. 2 shows an example of a system 300 with a controller 322 in communication with various sensors 324 and components 326. System 300 can be part of well site 10 including but not limited to the components and sensors discussed above with reference to FIG. 1. Sensors 324 can include position sensors, temperature sensors, load sensors, etc. For example, position sensors can include inclinometers and proximity switches (e.g., Hall Effect sensors), and load sensors can include load cells, current or voltage sensors, pressure sensors, and transducers. In some embodiments, sensors 324 include an intake pressure sensor, a discharge pressure sensor, a well head pressure sensor, torque sensor, and/or a shaft speed sensor. Sensors 324 can be operatively coupled to the controller 322 (e.g., via wire and/or wirelessly through wireless circuitry). Sensors 324 can be dynamometers for acquiring dynamic data, which may be transmitted and/or otherwise accessed by one or more pieces of equipment.

Controller 322 can utilize sensor data from sensors 324 to calculate or predict other values for determining fouling conditions. Controller 322 can utilize a model to indirectly estimate values of motor losses, surface and downhole flow speed, water cut and gas oil ratio (GOR) for determining conditions for fouling. The conditions for fouling can include a prediction or determination of average scaling thickness and housing skin temperature in some embodiments. Operators can diagnose fouling of components 326 using the model. Deviations from the ideal readings can indicate performance and various other anomalies due to fouling that may be identified and accounted for automatically or through manual intervention. Controller 322 can provide reports of indirectly sensed values, scaling levels, scaling rates, and/or surface temperatures in some embodiments. The controller 322 can execute a report application (e.g., an external application) that is configured to generate a report for a technician to view (e.g., graphs, charts, values described above, etc.).

In some embodiments, controller 322 can provide a dashboard that includes one or more graphs or tables of time-series data such as different outputs, predicted values, estimated values, system values, etc. For example, the graphs may include performance graphs, nodal analysis graphs, pressure to temperature ratio graphs, temperature graphs, liquid rate graphs, scaling graphs, skin temperature graphs, etc. The dashboard may be generated and provided to a technician for further analysis and control, according to some embodiments. The dashboard can also include different menus or sub-menus for navigation, according to some embodiments.

In some embodiments, components 326 include an ESP (pump 20 in FIG. 1) that pumps reservoir fluid to the surface. The ESP includes a centrifugal pump driven by a motor. The motor is located below the pump and is cooled by the produced fluid 12 (FIG. 1) passing by the motor housing. The centrifugal pump is directly exposed to the produced fluid 12 and is at least partially cooled by the produced fluid 12 in some embodiments. The motor is a three phase brushless motor powered from the surface (via transformers 24 in FIG. 1) in some embodiments. The motor is coupled to a power cable that is banded or clamped to production tubing from below well head 26 to the ESP because cable is not designed to support the weight of the ESP. In some embodiments, the power cable is a specially constructed three-phase power cable designed specifically for downhole well environments.

Figure 3:
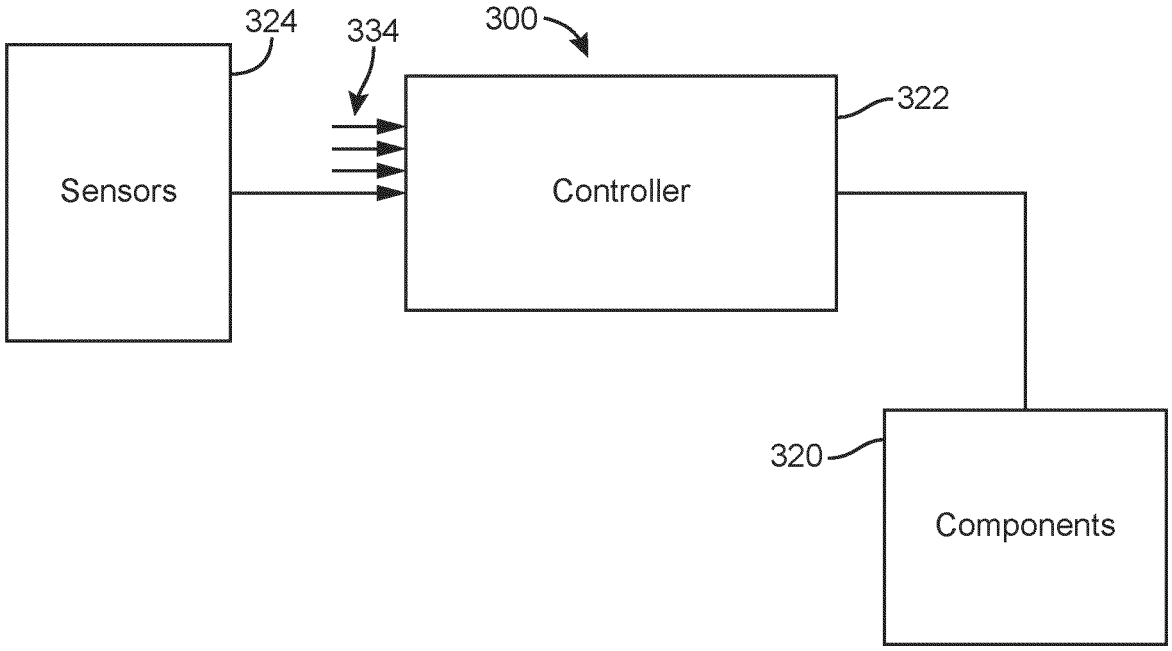
FIG. 3 is a schematic block diagram of a motor for use at the well site illustrated in FIG. 1 schematically showing motor losses, according to some embodiments.

Pump temperature is defined by or related to the intake temperature, pump efficiency, fluid properties and flow rate. The motor temperature distribution is dominated by the motor losses, the pump losses, the radial thermal heat transfer inside the motor, the axial heat transfer in the motor stator and housing, the heat transfer between motor housing and the fluid, fluid rate, heat capacity, conductivity and temperature in some embodiments. With reference to FIG. 3, motor losses include mechanical windage losses 372 in the gap between stator and rotor, electrical copper losses 374, and magnetic core losses 376. The gap is generally filled with oil for pressure compensation. For each cross-sectional layer inside the motor these losses create a temperature gradient from the center 380 to the housing 382 (temperature of motor $T_m$–temperature of skin $T_s$). Neglecting the axial heat transfer inside the rotor, these losses define the temperature difference between stator inner diameter and housing outer diameter. The stator and motor housing are the main thermal barrier. For the radial direction heat flux reduces with the $\ln(r_0/r_i)$. The motor cooling can be represented by $-2\lambda(T_m-T_s)\ln(r_0/r_i)dl$; where $r_0/r_i$ is a ratio of the motor housing radius to the stator inner radius, dl is the length segment, and $\lambda$ is the heat transfer coefficient (Watts per degree K meter) in some embodiments.

Heat transfer also occurs in the axial direction of the motor which is related to the temperature increase inside the fluid as the fluid passes the motor housing. For each cross-sectional layer inside the motor, these losses create a temperature gradient from the center 380 to the housing 382 (temperature of motor $T_m$–temperature of skin $T_s$). Neglecting the axial heat transfer inside the rotor these losses define the temperature difference between stator inner diameter and housing outer diameter, stator and motor housing are the main thermal barrier. The motor cooling can be represented by $-2\lambda(T_m-T_s)\ln(r_0/r_i)dl$ in some embodiments.

Axial heat transfer inside the motor housing also occurs between the motor housing and the protectors and pump housing. The fouling (e.g., scaling) is produced as reservoir fluids close to saturation undergo an additional temperature change that creates a fall out of solids or precipitate. The solids are deposited at the relative heat spot of components (e.g., at the housing or inside the pump). Scaling can add an additional thermal barrier between housing and fluid and therefor increases the temperature inside the motor.

In some embodiments, controller 322 (FIG. 2) receives data from actuator inputs 334 and sensors 324 including but not limited to: motor winding end turn temperature, intake temperature and pressure at the bottom of the assembly, discharge temperature and pressure at the top of the assembly, and electrical drive frequency. In some embodiments, controller 322 (FIG. 2) receives actuator inputs 334 and values from sensors 324 including but not limited to: motor winding end turn temperature, intake temperature and pressure at the bottom of the assembly, discharge temperature and pressure at the top of the assembly, electrical drive frequency, surface production choke setting, well head temperature and pressure, and flow line temperature and pressure. The received data is used to derive flow rate and housing or skin temperatures using a model. In some embodiments, controller 322 also derives downhole power dissipation, motor RPM (in case of asynchronous motors), related flow rate, housing temperature and peak motor winding temperatures using a model. The models can be used in a simple prediction context, where the estimate of the derived quantities is based on the best consistency between measurements and underlying models. In an optimization context, the models can be used to estimate the response to actuator change. Based on the present and past measurements, the reaction of the system to the actuator variation can be predicted to derive a desired response. For scaling prediction and cleaning, the optimization can be used to find the best combination of drive frequency and voltage, and production choke setting to avoid scaling or the optimum rate of scaling inhibitor injection or the optimum rate of cleaning fluid rate for descaling.

In some embodiments, controller 322 employs simple macroscopic bulk models that describe the system with first principles. In some embodiments, controller 322 employs a complex distributed 3 dimensional or 2 dimensional finite element analysis (FEA) models of motor pump, reservoir and flow lines. In some embodiments, controller 322 employs a data driven reduced order model based on regression. In some embodiments, the model is a regression based predicting model based on a data base of measurements, actuator setting and given responses as a learning sample. The regression model can be used with available measurements as inputs to predict the system responses. The data base can be derived from simulations of the system variability with a high precision simulation model, from measurements or a combination of both. For instance prediction models for scaling thickness can be derived from a run time historic measurement log and scaling measurements at a surface.

In some embodiments, controller 322 employs a 1D simulation model. The controller 322 can employ distributed (i.e. variables at multiple discretized locations) drift flux models to model the two phase flow in the casing and well, a distributed 1D pump model, a motor thermal and electrical motor model, a production choke model, a distributed flow line model and/or a variety of reservoir models from simple static drawdown models to tubular transient models. In some embodiments, the motor temperature sensor is located at the coolest point of the motor at the end turn junction below the lowest motor stator segment and the winding temperature varies more drastically depending on motor length and diameter, flow rate, power dissipation and fluid properties. A simulation based reduced order (ROM) model allows a prediction of maximum winding temperature and is therefore an enabler for an overheating prevention strategy. In some embodiments, the model is a multi-input, multi-output (MIMO) neuronal network based regression model. The multi-input, multi-output (MIMO) neuronal network based regression model advantageously provides consistency of the predicted responses. In some embodiments, sub models of different domains are all covered in a single simulation. In some embodiments, the ROMs can also be used based on sequential predictions and combined with simpler analytical models of sub sections to reduce complexity.

The ROMs can be any of a transient ROM (e.g., a reduced order model that outputs multiple values of variables for a transient or dynamic phase of the system), a static ROM, (e.g., a reduced order model that outputs static variables for a steady state phase of the system), a forward ROM (e.g., a reduced order model that predicts future values or what-if scenarios of various variables for one or more control decisions), an inverse ROM (e.g., a reduced order model that can be used to solve an inversion problem and estimate different system parameters based on actual measurements and/or calibration variables), or a calibration ROM (e.g., a reduced order model that can be used to estimate or predict different calibration variables of the system). Transient ROMs may be more complex than static or stead-state ROMs and may require additional elaboration or further techniques for generation, such as deconvolution, gradient search techniques, etc. The ROMs can be generated using an advanced regression technique, a neural network, and/or or machine learning technique. For example, the ROMs can be generated based on the outputs of the design and execution of experiments (DOE) using a linear regression technique, a Gaussian process regression technique, neural networks, XGBoost for regression, LGBoost, an auto-select (e.g., a Bayesian-based) regression technique, etc.

Figure 4:
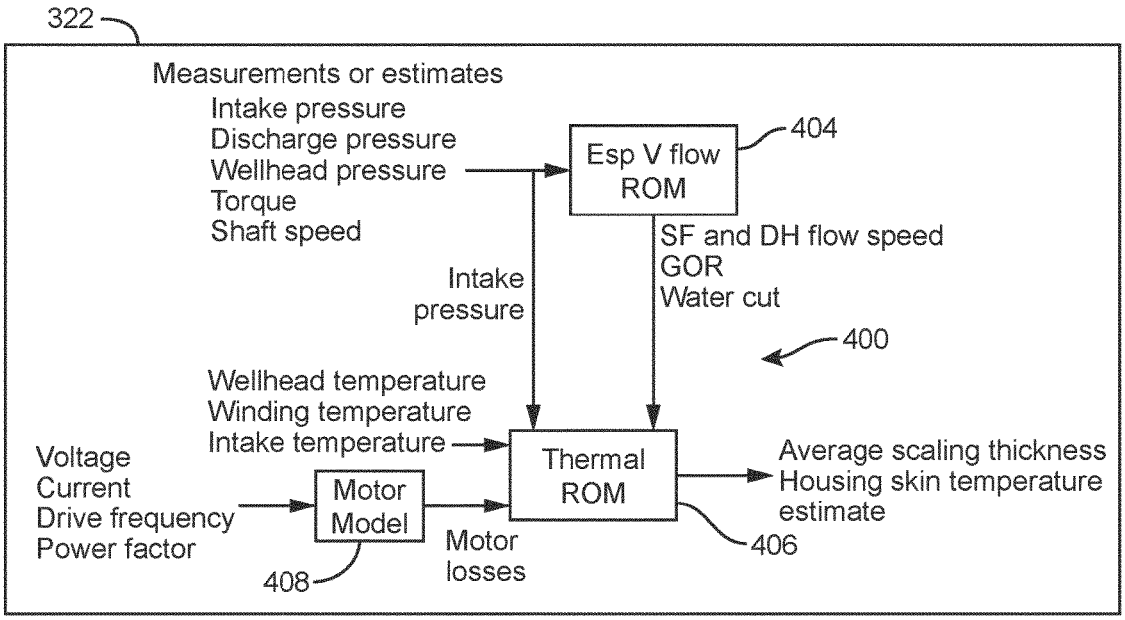
FIG. 4 is a schematic block diagram of a digital twin for skin temperature estimation and scaling detection.

With reference to FIG. 4, controller 322 can be implemented at least in part using a digital twin 400 for motor housing skin temperature estimation and scaling detection. Digital twin 400 includes an ESP flow ROM, a thermal model 406, and a motor model 408. Models 404, 406, and 408 cooperate to provide data so that an average scaling thickness and housing skin temperature estimate can be provided. The average scaling thickness and housing skin temperature estimate can be provided by thermal model 406 (e.g., ROM) in response to parameters provided by sensors 324 (FIG. 2) and values provided by models 404 and 408.

In some embodiments, thermal model 406 receives well head temperature data, winding temperature data, intake temperature data, and an intake pressure data from sensors 324, motor loss data from motor model 408, and GOR, water cut, and flow speed (e.g. DH and SF) data from ESP flow model 404. Motor model 408 is a model representing motor characteristics of the motor for the ESP. Motor model 408 receives voltage data, current data, drive frequency data, and power factor data for the motor and provides the motor loss data.

In some embodiments, ESP flow model 404 can be an ESP velocity flow ROM and receives well head data, torque data, shaft speed data, discharge pressure data, well head pressure data, and intake pressure data from sensors 324. Sensors 324 can include computing units that calculate the above mentioned data based upon raw sensor data. ESP flow model 404 provides GOR, water cut, and flow speed (e.g. downhole (DH) and surface (SF)) data.

The digital twin 400 may be generated based on the one or more ROMs that are created when performing a ROM creation technique. For example, the digital twin 400 may include several of the ROMs and interrelationships between the ROMs (e.g., which ROM feeds an output to an input of a different ROM). In one example, the digital twin 400 includes a calibration ROM, an inverse ROM, and a forward ROM. Outputs of the calibration ROM can be provided to both the inverse ROM and the forward ROM. Outputs of the inverse ROM may be provided to the forward ROM. The digital twin 400 can include one or more of the ROMs and is instantiated at a particular point in time based on the real-time inputs. The outputs of the ROMs that define the digital twin 400 for the instantiation at the particular point in time can the real-time outputs of the digital twin. In this way, the digital twin 400 operates based on real-time inputs to provide real-time outputs (e.g., actuations).

The digital twin 400 may be configured using offline techniques which can include using one or more simulators to perform DOE. The simulators and the DOE can be multiple what-if scenarios in a hyper dimensional space (e.g., different values of speed of the pump, GOR, temperature, fluid chemistry, or other parameters). For example, the simulators may be different models, equations, operational curves, etc., of various components, sub-systems, or devices of the system that the digital twin 400 represents, and may also include various interrelationships (e.g., which models feed into each other, etc.) of the various components, sub-systems, devices, etc., of the system that the digital twin 400 represents. The simulators and DOE can use advanced techniques based on known information of the system that the digital twin 400 represents so that excessive numbers of simulations do not need to be simulated. For example, the simulations may be performed in a hyper dimensional space of various variables within which the system is expected to operate. For example, if the system is a pump for a hydrocarbon system that is expected to operate at a pressure between 1000 and 3000 psi, the simulations may be performed for pressure in this range. In another example, if the system that the digital twin 400 represents is an ESP, the DOE can simulate or estimate choke percentage, water output, etc., for different values of manipulated variables (e.g., speed or rpm of the ESP), or different ranges of manipulated variables. The results of the DOE may be operational or hypothetical (e.g., simulated operational) curves of different output variables of the system that the digital twin 400 represents, given different ranges or values of input variables. The DOE may use Naïve DOE techniques, or randomized DOE sampling techniques (e.g., Latin hypercube DOE techniques, Sobol DOE techniques, Halton DOE techniques, etc.).

Advantageously, the systems and methods described herein can be used to provide a reliable digital twin of a real-world system. Using a digital twin that is an instantiation of one or more ROMs can improve a calculation speed, as opposed to using simulations, which may be computationally heavy. The digital twin 400 can be implemented in an online mode to use real-time measurements from the real-world system (e.g., a hydrocarbon well pump) for real-time control, analysis, optimization, etc. The digital twin 400 can be calibrated periodically to ensure that the digital twin accurately represents the real-world system.

Figure 5:
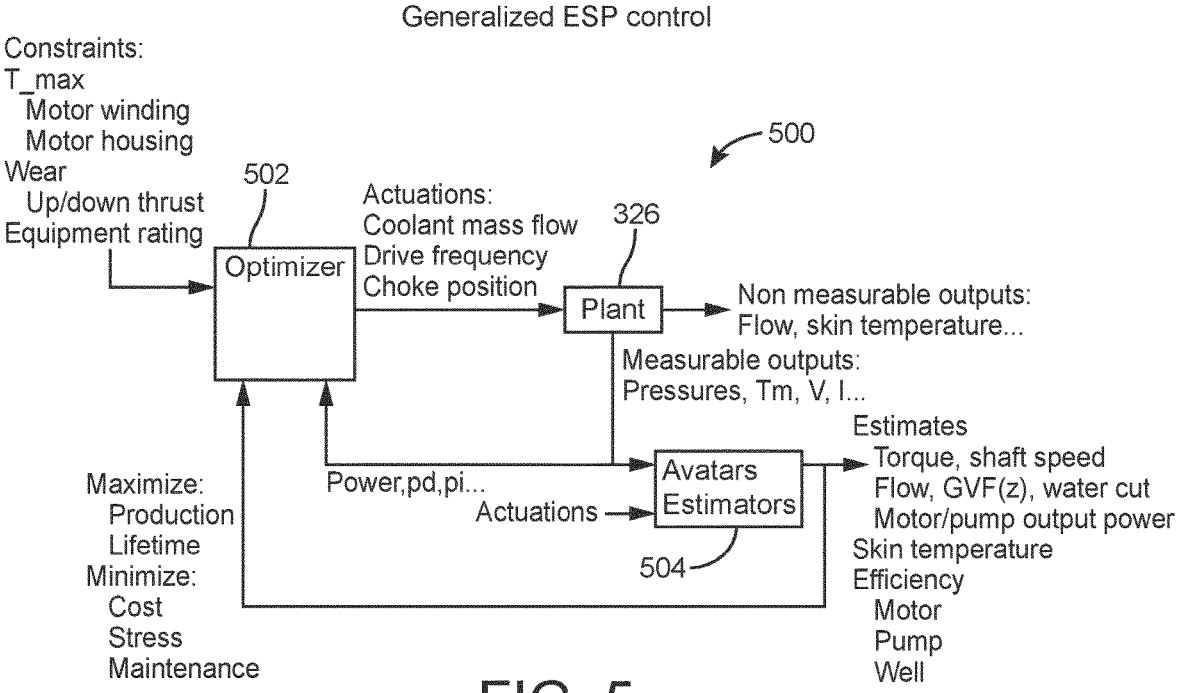
FIG. 5 is a flow diagram of an optimization using skin temperature estimation and scaling detection according to some embodiments.

With reference to FIG. 5, controller 322 can implement a workflow 500 using an optimizer 502. Optimizer 502 can be implemented as a ROM. Optimizer 502 receives constraints and provides actuations to components 326 or other plant equipment. In some embodiments, the optimizer 502 receives the following constraints: maximum temperature for the motor winding and the motor housing, up and down thrust wear, and equipment ratings. In some embodiments, optimizer 502 is configured to maximize one or more of the following parameters: production and life time and/or minimize the one or more of the following parameters: cost, stress, and maintenance. Optimizer 502 provides the following actuations in response to the constraints: cooling mass flow, drive frequency, and choke position. Avatars or estimators 504 can estimate torque, shaft speed, water cut, motor/pump output power, flow, GVF2, skin temperature, motor efficiency, pump efficiency, and well efficiency in some embodiments. Estimators 504 can receive actuations measured outputs from components 326 including but not limited to pressures, temperatures, voltage, current, etc. Estimators 504 can be embodied as ROMs.

Workflow 500 is configured to provide a sequential prediction with a mix of analytical models in some embodiments. Workflow 500 is used to estimate responses to actuator variation based on the present and past actuator settings and measurements. The simulated responses are then used in an optimization algorithm for optimizer 502 that minimized the difference between predicted and desired response and enforces hard constraints, such as a skin temperature limit below the saturation temperature of dissolved solids. The performance of the overall predictability depends on the set of measurements and model information. If a current or power factor measurement, for instance, is not available, a more complex model based on equivalent circuits or a simulation based ROM can be used. In multi-input, multi-output (MIMO) based ROM, estimates for torque, shaft speed, water cut, GOR which also can be related to a quantity estimate, motor/pump output power, flow, GVF(z): gas volume fraction at position z (GVF(z)), skin temperature, motor efficiency, pump efficiency, and well efficiency are provided by a single prediction ROM in some embodiments. To increase measurement and model accuracy (e.g., for water cut or GOR), a high consistency between pressure measurement and simulated pressure is desired in some embodiments.

In some embodiments, utilization of two-dimensional models and three-dimensional models of for various equations may each offer advantages relative to each other. On the one hand, two-dimensional models may require less computation and total bandwidth for a supervisory device such as the controller 322 or digital twin 400. On the other hand, three-dimensional models may require more computation and total bandwidth for the controller 322 or digital twin 400. For example, two-dimensional models may require three interrelated wave equations. Three-dimensional models, conversely, may require six interrelated wave equations: the three wave equations mentioned above, further integrated with three additional wave equations for identifying abscissa forces and/or displacement, as well as torsional forces and/or displacement. In spite of the additional computational requirements mentioned above, three-dimensional models may of course provide a more accurate model of solving the estimations and optimizations described above. Accordingly, either a two-dimensional or three-dimensional model may be desirable, dependent upon the particular complexity of well deviation, available computing resources, and so on. Generally, however, both the two-dimensional and three-dimensional models may each provide a substantial increase in computational complexity relative to one-dimensional models. The systems and methods described herein may provide an advantageous solution for capitalizing on the increased accuracy of using two-dimensional and/or three-dimensional models, while also limiting (or otherwise eliminating) at least the challenges mentioned above (if not others) otherwise associated with utilization of such models as opposed to a one-dimensional model.

It would be advantageous to provide systems and methods that not only leverage the improved accuracy associated with two-dimensional and/or three-dimensional models, while also limiting side-effects associated with increased computational requirements. Accordingly, the systems and methods provide herein may relate to a multi-stage process (as defined by the flow 500 above). For example, at a first stage of implementation and/or operation of the ESP (e.g., a "planning phase"), it may be advantageous to leverage the advantages of two-dimensional and/or three-dimensional models for determining a first model configured to solve the scaling and temperature calculations. At this planning phase, relationships between surface conditions and downhole conditions for the pump may be determined. At a second stage, the pump may then leverage one or more aspects of the first model (as described in greater detail below) to identify a second model that is otherwise less complex, and therefore more efficient, relative to the first model. For example, the first stage may be a planning phase (e.g., a phase primarily directed toward providing the pump for a new well, such as the well site 10). At this first stage, various expenses with construction and implementation of the pump system at the well site are involved. The second stage may thus be a "diagnostic stage" associated with actual operation of the pump system and determining downhole conditions in real-time. In the second stage, computational advantages produced at the first stage in regard to the first model may be leveraged to a particular point, though at the second stage an emphasis may be shifted, somewhat, toward agile computation, therefore presenting greater advantages in a leaner model for solving the equations, as described above.

Controller 322 includes processing circuitry including a processor and a memory. The processor can be a general purpose or specific purpose processor, an application specific integrated circuit (ASIC), one or more field programmable gate arrays (FPGAs), a group of processing components, a digital signal processor, a server, or other suitable processing components. The processor may be configured to execute computer code and/or instructions stored in the memory or received from other computer readable media (e.g., CDROM, network storage, a remote server, etc.).

The memory can include one or more devices (e.g., memory units, memory devices, storage devices, etc.) for storing data and/or computer code for completing and/or facilitating the various processes described in the present disclosure. The memory can include random access memory (RAM), read-only memory (ROM), hard drive storage, temporary storage, non-volatile memory, flash memory, optical memory, or any other suitable memory for storing software objects and/or computer instructions. The memory can include database components, object code components, script components, or any other type of information structure for supporting the various activities and information structures described in the present disclosure. The memory can be communicably connected to the processor via the processing circuitry and can include computer code for executing (e.g., by the processor) one or more processes described herein.

The memory includes one or more simulators, a DOE manager, a ROM generator, a digital twin generator, models 404, 406, and 408, and digital twin 400, according to some embodiments. As shown in FIG. 2, the controller 322 is configured to receive real-time inputs from sensors 324 and actuators. The real-time inputs may be obtained from sensors, measurement devices, meters, flow meters, data aggregators, etc. according to some embodiments. The digital twin 400 is also configured to receive system information (e.g., from a technician, from a remote device, from a database, etc.), according to some embodiments. In some embodiments, the system information is meta-data regarding the well site 10. In some embodiments, the system information is stored in the memory.

The simulators can be or include one or more functions, models, operational curves, etc., that represent different portions of the well site 10, and/or one or more interrelationships of the one or more functions, models, operational curves, etc., of the different portions of the well site so that outputs can be simulated, according to some embodiments. The simulators can be configured to implement a multi-variable or hyper-dimensional simulation of the well site 10 or components thereof to generate different outputs given different inputs (e.g., control inputs, temperature settings, flow rates, pump speed, etc., depending on a type of components, according to some embodiments. For example, the simulators may be configured to perform a high-fidelity simulation. For example, the simulators can include an electric submersible pump (ESP) simulator, a rod pump dynamic simulator, a heat exchanger simulator, a valve simulator, a motor simulator, well head simulator, a motor drive simulator, a pipe simulator, etc. The simulation outputs of the simulators may be in the form of multi-dimensional graphs, curves, surface plots, etc., that express relationships between different variables (e.g., input and output variables of the system), according to some embodiments.

Configuration of Exemplary Embodiments

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (i.e., permanent or fixed) or moveable (i.e., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (i.e., directly coupled), the generic definition of "coupled" provided above is modified by the plain language meaning of the additional term (i.e., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (i.e., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure.

It is important to note that the construction and arrangement of the apparatus as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A pump system for a pump disposed within a well, the pump system comprising:

a controller comprising an optimizer configured to receive constraints and provide activations to the pump to maximize production and lifetime or minimize cost, stress or maintenance; and an estimator configured to estimate an estimated factor in response to measured parameters from the pump, the estimated factor comprising skin temperature, wherein the optimizer is configured to receive the estimated factor, and wherein the controller is configured to operate the pump using the activations.

2. The system of claim 1, wherein the pump comprises an electric motor and the constraints comprise one or more of: a maximum temperature of a motor winding of the motor, a maximum temperature of a motor housing of the motor, or equipment ratings.

3. The system of claim 1, wherein the pump comprises an electric motor and the constraints comprise: a maximum temperature of a motor winding of the motor, a maximum temperature of a motor housing of the motor, and equipment ratings.

4. The system of claim 1, wherein the activations comprising a cooling mass flow, a drive frequency, and a choke position.

5. The system of claim 1, wherein the measured parameters comprise a pressure, a motor voltage, or a motor current.

6. The system of claim 1, wherein the activations comprising a cooling mass flow.

7. The system of claim 1, wherein the activations are provided to the pump to maximize production.

8. The system of claim 1, wherein the estimator comprises a digital twin configured to estimate the skin temperature and to detect scaling thickness in the pump system, wherein the digital twin comprises a thermal model, and a motor model for providing data so that the scaling thickness and the skin temperature can be provided.

9. The system of claim 8, wherein the motor model comprises a reduced order model.

10. A pump system for a pump disposed within a well, wherein the pump comprises an electric motor, the pump system comprising:

a controller comprising an optimizer configured to receive constraints and provide activations to the pump to maximize production and lifetime or minimize cost, stress or maintenance; and an estimator configured to estimate an estimated factor in response to measured parameters from the pump using a thermal model and a motor model, the estimated factor comprising skin temperature, wherein the optimizer is configured to receive the estimated factor, and wherein the controller is configured to operate the pump using the activations.

11. The system of claim 10, wherein the activations comprising a cooling mass flow.

12. The system of claim 10, wherein the activations are provided to the pump to maximize production.

13. The system of claim 10, wherein the estimator comprises a digital twin configured to estimate the skin temperature.

14. The system of claim 13, wherein the digital twin comprises a motor model for providing data so that scaling thickness and the skin temperature can be provided.

15. The system of claim 10, wherein the motor model comprises a reduced order model.

16. The system of claim 10, wherein the thermal model comprises a reduced order model.

17. A pump system for an electric subsurface pump disposed within a well, the pump system comprising:

a controller comprising an optimizer configured to receive constraints and provide activations to the pump to maximize production and lifetime or minimize cost, stress or maintenance; and an estimator configured to estimate an estimated factor in response to measured parameters from the pump using a thermal model and a motor model, the estimated factor comprising skin temperature, wherein the optimizer is configured to receive the estimated factor, and wherein the controller is configured to operate the pump using the activations.

18. The pump system of claim 17, wherein the controller is configured to maximize efficiency of injected scaling inhibitor, to maximize efficiency of injected cleaning fluid for cleaning cycles, or to maximize efficiency of injected cooling fluid to lowering operating temperatures.

19. The pump system of claim 18, wherein the controller is configured to manage rate of scale buildup over time to maximize useful life.

20. The pump system of claim 18, wherein the thermal model comprises a reduced order model.

* * * * *